US009574559B2

(12) United States Patent
Shiotani et al.

(10) Patent No.: US 9,574,559 B2
(45) Date of Patent: Feb. 21, 2017

(54) OIL PUMP ROTOR

(71) Applicant: DIAMET CORPORATION, Niigata-shi (JP)

(72) Inventors: Atsushi Shiotani, Niigata (JP); Eiichiro Niizuma, Niigata (JP)

(73) Assignee: DIAMET CORPORATION, Niigata-shi (JP)

( * ) Notice: Subject to any disclaimer, the term of this patent is extended or adjusted under 35 U.S.C. 154(b) by 462 days.

(21) Appl. No.: 14/236,455

(22) PCT Filed: Dec. 13, 2012

(86) PCT No.: PCT/JP2012/082423
§ 371 (c)(1),
(2) Date: Jan. 31, 2014

(87) PCT Pub. No.: WO2013/089203
PCT Pub. Date: Jun. 20, 2013

(65) Prior Publication Data

US 2014/0178233 A1 Jun. 26, 2014

(30) Foreign Application Priority Data

Dec. 14, 2011 (JP) ..... 2011-273866

(51) Int. Cl.
*F04C 2/10* (2006.01)
*F04C 2/08* (2006.01)

(52) U.S. Cl.
CPC ..... *F04C 2/10* (2013.01); *F04C 2/084* (2013.01); *F04C 2/102* (2013.01); *F04C 2270/12* (2013.01); *F04C 2270/17* (2013.01)

(58) Field of Classification Search
CPC ..... F04C 2/102; F04C 2270/17; F04C 2/10
(Continued)

(56) References Cited

U.S. PATENT DOCUMENTS 6,077,059 A * 6/2000 Hosono ..... F04C 2/10 418/150
6,887,056 B2 * 5/2005 Hosono ..... F04C 2/10 418/150

(Continued)

FOREIGN PATENT DOCUMENTS

EP 1016784 A 7/2000
EP 1340914 A 9/2003

(Continued)

OTHER PUBLICATIONS

Communication pursuant to Article 94(3) EPC mailed Oct. 1, 2015 for the corresponding European Application No. 12857431.6.

(Continued)

*Primary Examiner* — Mary A Davis
*Assistant Examiner* — Anthony Ayala Delgado
(74) *Attorney, Agent, or Firm* — Leason Ellis LLP.

(57) ABSTRACT

Provided is an oil pump rotor capable of improving a volume efficiency and a quietness. When a diameter of a base circle bi of an inner rotor is Φ bi; a diameter of a first outer rolling circle Di is Φ Di; a diameter of a first inner rolling circle di is Φ di; a diameter of a base circle bo of an outer rotor is Φ bo; a diameter of a second outer rolling circle Do is Φ Do; a diameter of a second inner rolling circle do is Φ do; and an eccentricity amount between the inner rotor and the outer rotor is e, Φ bi=n·(Φ Di+Φ di) and Φ bo=(n+1)·(Φ Do+Φ do) hold; either Φ Di+Φ di=2e or Φ Do+Φ do=2e holds; and Φ Do>Φ Di and Φ di>Φ do hold. When a clearance between the inner rotor and the outer rotor is t, 0.3≤((Φ Do+Φ do)−(Φ Di+Φ di))·(n+1)/t≤0.6 holds, provided that Φ Di+Φ di=2e; or 0.3≤((Φ Do+Φ do)−(Φ Di+Φ di))·n/t≤0.6 holds, provided that Φ Do+Φ do=2e.

5 Claims, 12 Drawing Sheets

(58) Field of Classification Search
USPC ..... 418/61.3, 166, 150, 171
See application file for complete search history.

(56) References Cited

U.S. PATENT DOCUMENTS

| | | | | |
|---|---|---|---|---|
| 7,476,093 | B2 * | 1/2009 | Hosono | F04C 2/084 418/150 |
| 7,588,429 | B2 * | 9/2009 | Hosono | F04C 2/084 418/150 |
| 8,096,795 | B2 | 1/2012 | Ono et al. | |
| 2006/0239848 | A1 * | 10/2006 | Hosono | F04C 2/102 418/150 |

FOREIGN PATENT DOCUMENTS

| | | | |
|---|---|---|---|
| JP | 3734617 | B | 1/2006 |
| JP | 4393943 | B | 1/2010 |
| JP | 4485770 | B | 6/2010 |
| JP | 4650180 | B | 3/2011 |

OTHER PUBLICATIONS

International Search Report mailed Mar. 19, 2013 for the corresponding PCT Application No. PCT/JP2012/082423.
European Search Report mailed Feb. 27, 2015 for the corresponding European Application No. 12857431.6.

* cited by examiner

OIL PUMP ROTOR

CROSS-REFERENCE TO RELATED PATENT APPLICATIONS

This application is a U.S. National Phase Application under 35 U.S.C. §371 of International Patent Application No. PCT/JP2012/082423, filed Dec. 13, 2012, and claims the benefit of Japanese Patent Application No. 2011-273866, filed on Dec. 14, 2011, all of which are incorporated by reference in their entirety herein. The International Application was published in Japanese on Jun. 20, 2013 as International Publication No. WO/2013/089203 under PCT Article 21(2).

FIELD OF THE INVENTION

The present invention relates to an oil pump rotor capable of drawing in and then discharging a fluid as volumes of cells formed between an inner rotor and an outer rotor change.

BACKGROUND OF THE INVENTION

A conventional oil pump includes: an inner rotor having n (n is a natural number) external teeth; an outer rotor having n+1 internal teeth that are engageable with the external teeth; and a casing having an intake port for drawing in a fluid and a discharge port for discharging the same. Particularly, the external teeth and the internal teeth engage with one another as the inner rotor rotates, thereby allowing the outer rotor to rotate such that a fluid can be drawn in and discharged as volumes of a plurality of cells formed between the two rotors change.

The cells are individually established as the external teeth of the inner rotor and the internal teeth of the outer rotor individually come into contact with one another on a forward side and a backward side of a rotational direction. Further, each cell has both of its side surfaces surrounded by the casing. Thus, the cells are configured as individual fluid transferring chambers. Particularly, each cell draws in a fluid as the volume thereof enlarges when moving along the intake port, after the volume of the corresponding cell has reached its minimum level during the process of engaging the external teeth and the internal teeth with one another. In contrast, the cell discharges the fluid as the volume thereof decreases when moving along the discharge port, after the volume of the corresponding cell has reached its maximum level during the aforementioned process.

Since an oil pump configured as above is small and has a simple structure, it can be widely used as, for example, a lubricating oil pump and an automatic transmission oil pump that are installed in automobiles. When used in an automobile, the oil pump is driven by, for example, allowing the inner rotor to be directly coupled to a crankshaft of an engine such that the oil pump can be driven as the engine rotates; or the oil pump may also be driven by, for example, allowing the inner rotor to be coupled to an electric motor.

As for the aforementioned oil pump, for the purpose of reducing the noise of the pump and improving a mechanical efficiency, tip clearances of an appropriate size are provided between the tooth tips of the inner rotor and the tooth tips of the outer rotor at where the inner rotor and the outer rotor, while being coupled to each other, have been rotated by 180° from an engagement point.

Here, the conditions required for determining the tooth shapes of an inner rotor ri and an outer rotor ro are as follows. That is, as for the inner rotor ri, rolling distances of a first outer rolling circle Di' (diameter ΦDi') and a first inner rolling circle di' (diameter Φdi') should add up to one cycle. That is, the rolling distances of the first outer rolling circle Di' and the first inner rolling circle di' should altogether be equal to the circumference of a base circle bi' (diameter Φbi') of the inner rotor ri, and hence $$\Phi\ bi'=n\cdot(\Phi\ Di'+\Phi\ di')$$

Likewise, as for the outer rotor ro, rolling distances of a second outer rolling circle Do' (diameter ΦDo') and a second inner rolling circle do' (diameter Φdo') should altogether be equal to the circumference of a base circle bo' (diameter Φbo') of the outer rotor ro, and hence.

$$\Phi\ bo'=(n+1)\cdot(\Phi\ Do'+\Phi\ do')$$

Next, since the inner rotor ri and the outer rotor ro are to be engaged with each other, the expression Φ Di'+Φ di'=Φ Do'+Φ do'=2 e' holds, provided that an eccentricity amount of the two rotors ri and ro is e'. Based on the aforementioned expressions, the expression n·Φ bo'=(n+1)·Φ bi' holds. The tooth shapes of the inner rotor ri and the outer rotor ro are configured to satisfy these requirements. Here, by satisfying the expressions $$\Phi\ Do'=Di'+t/2,\ \Phi\ do'=di'-t/2$$

(t: clearance between the external teeth of the inner rotor ri and the internal teeth of the outer rotor ro), not only a clearance t/2 (tip clearance tt) is formed at the tip section as shown in FIG. 14 and FIG. 15, but a clearance (side clearance ts) between the tooth surfaces is also formed.

FIG. 13 to FIG. 15 show an oil pump rotor of an first example of conventional arts that meets the aforementioned conditions. As for the inner rotor ri of this oil pump rotor, the base circle bi' has a diameter of Φ bi'=44.80 mm; the first outer rolling circle Di' has a diameter of Φ Di'=3.60 mm; the first inner rolling circle di' has a diameter of Φ di'=2.80 mm; and the teeth number is n=7. As for the outer rotor ro, the outer diameter thereof is Φ 65 mm; the base circle bo' has a diameter of Φ bo'=51.20 mm; the second outer rolling circle Do' has a diameter of Φ Do'=3.663 mm; the second inner rolling circle do' has a diameter of Φ do'=2.737 mm; and the teeth number is (n+1)=8. In addition, the eccentricity amount is e'=3.2 mm.

As for the oil pump rotor of Japanese Patent No. 3734617 (referred to as first example of conventional arts hereunder) that has the aforementioned structure, the two rotors are so configured that the tooth shapes of the tooth tips of the inner rotor are formed smaller than the tooth shapes of the tooth grooves of the outer rotor, and that the tooth shapes of the tooth grooves of the inner rotor are formed larger than the tooth shapes of the tooth tips of the outer rotor. For this reason, a backlash and the tip clearance tt can respectively be set to be appropriately large, thereby making it possible to secure a large backlash while maintaining a small tip clearance tt. Thus, in a state where an oil pressure supplied to the oil pump rotor and a torque for driving the oil pump rotor are stable, it is possible to restrict the occurrence of the noises resulting from the collision between the external teeth of the inner side and the internal teeth of the outer side.

However, by adjusting the diameters of the second outer rolling circle Do' and the second inner rolling circle do' of the outer rotor in this manner, securing the tip clearance tt=t/2 shall inevitably cause the side clearance is to become large as shown in FIG. 14 and FIG. 15. Accordingly, the following problem remains unsolved with regard to the quietness of this oil pump rotor. That is, when the oil pressure occurring in the oil pump rotor is minute and the torque for driving the oil pump rotor changes, the internal teeth of the outer side and the external teeth of the inner side collide with one another such that collision energies at that time are turned into sounds. Those sounds can then be turned into noises after reaching an audible level.

An oil pump rotor configured in view of the aforementioned problem (e.g. Japanese Patent No. 4485770) has been proposed. As shown in FIG. 7 and FIG. 8, this oil pump rotor includes: an inner rotor 10 having "n" (n is a natural number) external teeth 11; an outer rotor 20 having "n+1" internal teeth 21 engageable with the external teeth 11; and a casing 50 having an intake port for a fluid to be drawn thereinto and a discharge port for the fluid to be discharged therefrom. Particularly, this oil pump rotor is used in an oil pump transferring a fluid by drawing in and discharging the same as volumes of cells formed between the tooth surfaces of the two rotors 10, 20 change when the two engaged rotors 10, 20 rotate. As for the aforementioned inner rotor 10, the shape of each tooth tip is established by an epicycloid curve that is generated by a first outer rolling circle Di externally tangent to and rolling on a base circle bi of the inner rotor 10 without slipping. The shape of each tooth groove of the inner rotor 10 is established by a hypocycloid curve that is generated by a first inner rolling circle di internally tangent to and rolling within the base circle bi without slipping. As for the aforementioned outer rotor 20, the shape of each tooth groove is established by an epicycloid curve that is generated by a second outer rolling circle Do externally tangent to and rolling on a base circle bo of the outer rotor 20 without slipping. The shape of each tooth tip of the outer rotor 20 is established by a hypocycloid curve that is generated by a second inner rolling circle do internally tangent to and rolling within the base circle bo without slipping. The inner rotor 10 and the outer rotor 20 are so configured that when the diameter of the base circle bi of the inner rotor 10 is Φ bi; the diameter of the first outer rolling circle Di is Φ Di; the diameter of the first inner rolling circle di is Φ di; the diameter of the base circle bo of the outer rotor 20 is Φ bo; the diameter of the second outer rolling circle Do is Φ Do; the diameter of the second inner rolling circle do is Φ do; and an eccentricity amount between the inner rotor 10 and the outer rotor 20 is e, the expression $\Phi bi=n\cdot(\Phi Di+\Phi di)$ and the expression $\Phi bo=(n+1)\cdot(\Phi Do+\Phi do)$ hold; the expression $\Phi Di+\Phi di=2e$ or $\Phi Do+\Phi do=2e$ holds; and the expressions $\Phi Do>\Phi Di$, $\Phi di>\Phi do$ and $(\Phi Di+\Phi di)<(\Phi Do+\Phi do)$ hold. Here, a backlash at an engagement point where a tooth tip of the outer rotor 20 and a tooth groove of the inner rotor 10 directly face each other; and a backlash during the process where the volumes of the cells increase and decrease, are smaller than a backlash at where the volume of a cell reaches its maximum level.

As for the oil pump rotor of Japanese Patent No. 4485770, the two rotors 10 and 20 exhibit small backlashes such that an oil pump rotor superior in quietness can be obtained. Particularly, the oil pressure occurring in the oil pump rotor is minute; and even if the torque for driving this oil pump rotor changes, noise occurrence due to the collisions between the internal teeth 21 of the outer side and the external teeth 11 of the inner side can be reliably restricted.

Problems to be Solved by the Invention

As for the oil pump of the Japanese Patent No. 4485770, the backlash at the engagement point where the tooth tip of the outer rotor 20 and the tooth groove of the inner rotor 10 directly face each other; and the backlash during the process where the volumes of the cells increase and decrease, are smaller than the backlash at where the volume of a cell C reaches its maximum level. Since the backlash at the engagement point where the tooth tip of the outer rotor 20 and the tooth groove of the inner rotor 10 directly face each other is small, even if the torque for driving this oil pump rotor changes, noise occurrence due to the collisions between the internal teeth 21 of the outer side and the external teeth 11 of the inner side can be reliably restricted. However, there arises a concern that vibration sounds may occur due to a rotation fluctuation caused by the acceleration or deceleration of the outer rotor 20.

FIG. 9 to FIG. 12 are diagrams showing correlations between angles of rotation of the inner rotor 10 and intertooth clearances with regard to the oil pump rotor of the second example of conventional arts. Here, intertooth clearances refer to clearances between the internal teeth 21 of the outer rotor 20 and the external teeth 11 of the inner rotor 10, in a rotational direction of the corresponding external teeth. Shown in these diagrams are correlations between the angles of rotation θ of the inner rotor 10 and the intertooth clearances at the locations of I, II, III and VI. An angle of rotation θ is the angle ranging over one tooth of the inner rotor 10. The location of I is a location where a tooth groove of the outer rotor 20 and a tooth tip of the inner rotor 10 engage with each other. As the engaged state at the location of I rotates by about ½ of the angle of rotation θ ranging over one tooth, the intertooth clearance at the location of I shall slightly increase, whereas the intertooth clearance at the location of VI shall rapidly decrease, thus allowing the engaged state to switch from the location of I to the location of VI at an engagement switching point. Here, it is understood that the intertooth clearances at the locations of II and III also vary.

Next, diagrammatically shown in FIG. 10 by arrows YI and YVI are the displacement velocities of respectively the intertooth clearance at the location of I and the intertooth clearance at the location of VI, at the "engagement switching point." Since the displacement velocities of the two are not synchronized, tooth contact noises occur as the engagement switches.

Further, as shown in FIG. 11, in a range where the angle of rotation θ of the inner rotor 10 reaches the "engagement switching point" from 0 degree, since the intertooth clearance at the location of I remains substantially constant before reaching the "engagement switching point" by slightly increasing, a state of "minute deceleration" where the rotary speed of the outer rotor 20 slightly decreases is observed on the left side of the "engagement switching point" in the diagram. In contrast, it is clear that beyond the "engagement switching point" toward the right side of the diagram, since the intertooth clearance at the location of VI keeps decreasing until a slope of change thereof reaches 0, the rotation of the outer rotor 20 accelerates during such period, and then allows the intertooth clearance to gradually increase thereafter such that the state of "minute deceleration" is established. In this way, since the outer rotor 20 switches from the state of minute deceleration to the state of acceleration before and after the "engagement switching point," there arises a concern that vibration noises may occur.

Further, when improving a fluid tightness by reducing a backlash at where the cell C reaches its maximum level for the purpose of improving volume efficiency, the backlashes between the teeth shall become small as a whole, thus resulting in a situation in which since the backlashes at where the tooth tips of the inner rotor and the tooth grooves of the outer rotor engage by directly facing one another are exceedingly small, the teeth may interfere with one other due to a variation in the shapes thereof such that noises may occur.

SUMMARY OF THE INVENTION

Here, it is an object of the present invention to provide an oil pump rotor having an inner rotor and an outer rotor whose teeth are both formed into appropriate shapes; and exhibiting a constant minimum intertooth clearance between the two rotors such that a quietness and a volume efficiency can be improved thereby.

Particularly, the minimum intertooth clearance refers to a clearance by which the external teeth 11 of the inner rotor and the internal teeth 21 of the outer rotor are at their closest to each other regardless of a rotational direction.

The invention of a first aspect is an oil pump rotor for use in an oil pump transferring a fluid by drawing in and discharging the fluid as volumes of cells formed between tooth surfaces of two rotors change when the two rotors rotate while being engaged with each other, comprising:

an inner rotor having n (n is a natural number) external teeth, the inner rotor exhibiting a tooth tip shape established by an epicycloid curve that is generated by a first outer rolling circle Di externally tangent to and rolling on a base circle bi of the inner rotor without slipping and a tooth groove shape established by a hypocycloid curve that is generated by a first inner rolling circle di internally tangent to and rolling within the base circle bi without slipping;

an outer rotor having n+1 internal teeth, the outer rotor exhibiting a tooth groove shape established by an epicycloid curve that is generated by a second outer rolling circle Do externally tangent to and rolling on a base circle bo of the outer rotor without slipping and a tooth tip shape established by a hypocycloid curve that is generated by a second inner rolling circle do internally tangent to and rolling within the base circle bo without slipping; and a casing having an intake port for drawing in a fluid and a discharge port for discharging the fluid, wherein when a diameter of the base circle bi of the inner rotor is $\Phi$ bi; a diameter of the first outer rolling circle Di is $\Phi$ Di; a diameter of the first inner rolling circle di is $\Phi$ di; a diameter of the base circle bo of the outer rotor is $\Phi$ bo; a diameter of the second outer rolling circle Do is $\Phi$ Do; a diameter of a second inner rolling circle do is $\Phi$ do; and an eccentricity amount between the inner rotor and the outer rotor is e, $\Phi bi=n\cdot(\Phi Di+\Phi di)$ and $\Phi bo=(n+1)\cdot(\Phi Do+\Phi do)$ hold; either $\Phi Di+\Phi di=2e$ or $\Phi Do+\Phi do=2e$ holds; and $\Phi Do>\Phi Di$, $\Phi di>\Phi do$ and $(\Phi Di+\Phi di)<(\Phi Do+\Phi do)$ hold, and wherein when a clearance between the inner rotor and the outer rotor is t, $0.3<((\Phi Do+\Phi do)-(\Phi Di+\Phi di))\cdot(n+1)/t\leq 0.6$ holds, provided that $\Phi Di+\Phi di=2e$; or $0.3\leq((\Phi Do+\Phi do)-(\Phi Di+\Phi di))\cdot n/t\leq 0.6$ holds, provided that $\Phi Do+\Phi do=2e$.

According to the invention of an second aspect, the external teeth of the inner rotor and the internal teeth of the outer rotor exhibit therebetween a minimum intertooth clearance with a deviation of not larger than 10 at all locations where the external teeth of the inner rotor and the internal teeth of the outer rotor are adjacent to one another.

According to the invention of a third aspect, the deviation of the minimum intertooth clearance is not larger than 5 μm.

According to the invention of a fourth aspect, the minimum intertooth clearance is 35 to 45 μm.

According to the invention of a fifth aspect, the minimum intertooth clearance is 37.5 to 42.5 μm.

Effects of the Invention

According to the aforementioned structure, there can be obtained an oil pump rotor having a superior quietness. Particularly, since the displacement velocities of the intertooth clearances before and after the engagement switches are synchronized, and since the engagement intertooth clearances can be made substantially uniform, tooth contact noises and noises due to a rotation fluctuation of the outer rotor can be restricted. Further, for the purpose of improving volume efficiency, by reducing the minimum intertooth clearance at where the cell C reaches its maximum level, the teeth can be prevented from interfering with one another and noises can be restricted due to the fact that the minimum intertooth clearances at other locations shall not be small even when improving a fluid tightness.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Preferred embodiments of the present invention are described in detail with reference to the accompanying drawings. However, the embodiments shown hereunder shall not limit the contents of the present invention that are described in this application. Further, not all elements described hereunder are essential to the present invention. Since each embodiment employs an unconventional oil pump rotor, an unconventional oil pump rotor is obtained. This oil pump rotor is disclosed hereunder.

First Embodiment

Figure 1:
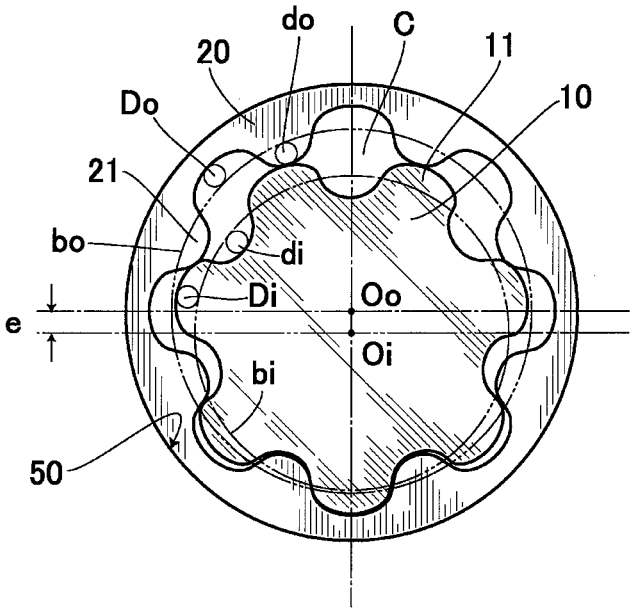
FIG. 1 is a plane view of an oil pump rotor of a first embodiment of the present invention.
Figure 2:
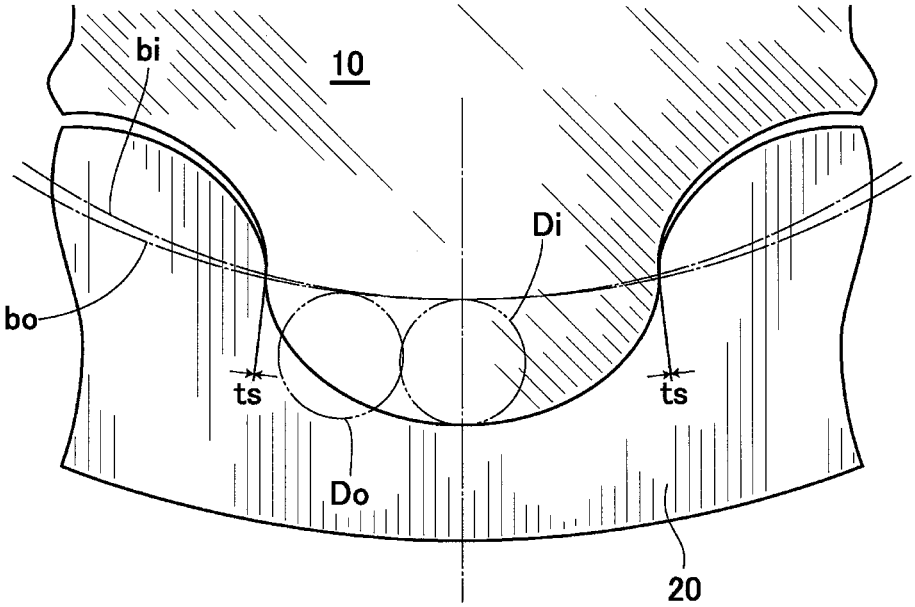
FIG. 2 is an enlarged view of an engaged section of the oil pump rotor of the first embodiment shown in FIG. 2.
Figure 3:
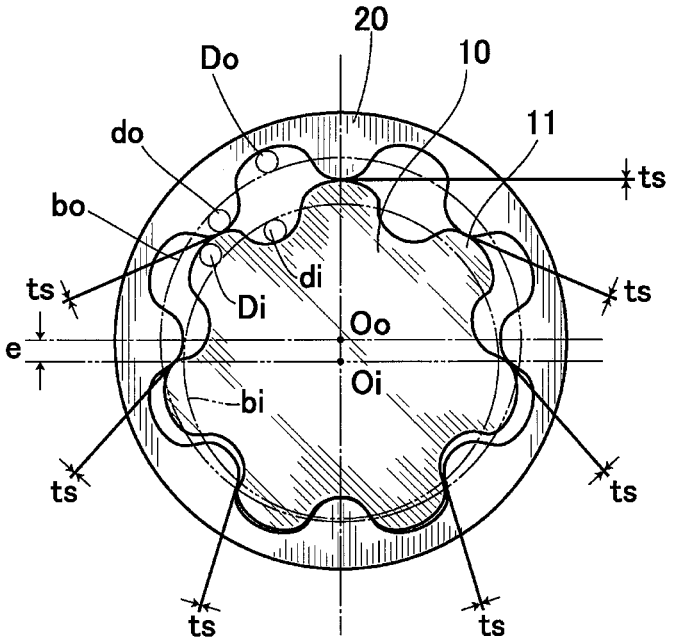
FIG. 3 is a plane view of the oil pump rotor of the first embodiment, in which locations of minimum intertooth clearances are shown.

A first embodiment of the present invention is described in detail with reference to the accompanying drawings. Here, elements identical to those of examples of conventional arts are given identical symbols in the following description. As shown in FIG. 1 to FIG. 3, an oil pump rotor includes: an inner rotor 10 having "n" external teeth (n is a natural number; n=7 in this embodiment); and an outer rotor 20 having "n+1" (8 in this embodiment) internal teeth engageable with the external teeth. The inner rotor 10 and the outer rotor 20 are received in a casing 50.

Here, a plurality of cells C are formed between the tooth surfaces of the inner rotor 10 and the outer rotor 20 in a manner such that the cells C are actually provided along rotational directions of the rotors 10, 20. In a forward and backward rotational directions of the rotors 10, 20, each cell C is individually established as a result of allowing external teeth 11 of the outer rotor 10 and internal teeth 21 of the outer rotor 20 to come into contact with one another; and both sides of this cell C are surrounded by the casing 50. In this way, there are formed individual fluid transfer chambers. Moreover, the cells C rotate as the rotors 10, 20 rotate, in a manner such that each cell C repeatedly exhibits an increase and decrease in its volume within each rotational cycle as one cycle.

The inner rotor 10 is attached to a rotary shaft, and is rotatably supported thereby around a shaft center Oi. The shape of each tooth tip of the inner rotor 10 is established by an epicycloid curve that is generated by a first outer rolling circle Di externally tangent to and rolling on a base circle bi of the inner rotor 10 without slipping. The shape of each tooth groove of the inner rotor 10 is established by a hypocycloid curve that is generated by a first inner rolling circle di internally tangent to and rolling within the base circle bi without slipping.

The outer rotor 20 whose shaft center is Oo is eccentrically disposed with respect to the shaft center Oi of the inner rotor 10 (eccentricity amount: e), and is rotatably supported within the casing 50 about the shaft center Oo. The shape of each tooth groove of the outer rotor 20 is established by an epicycloid curve that is generated by a second outer rolling circle Do externally tangent to and rolling on a base circle bo of the outer rotor 20 without slipping. The shape of each tooth tip of the outer rotor 20 is established by a hypocycloid curve that is generated by a second inner rolling circle do internally tangent to and rolling within the base circle bo without slipping.

The following relational expressions hold between the inner rotor 10 and the outer rotor 20, provided that a diameter of the base circle bi of the inner rotor 10 is Φ bi; a diameter of the first outer rolling circle Di is Φ Di; a diameter of the first inner rolling circle di is Φ di; a diameter of the base circle bo of the outer rotor 20 is Φ bo; a diameter of the second outer rolling circle Do is Φ Do; and a diameter of the second inner rolling circle do is Φ do. Here, mm (millimeter) is used as the measurement unit.

As for the inner rotor 10, rolling distances of the first outer rolling circle Di and the first inner rolling circle di should add up to one cycle. That is, the rolling distances of the first outer rolling circle Di and the first inner rolling circle di should altogether be equal to the circumference of the base circle bi.

$$\Phi\ bi = n\cdot(\Phi\ Di + \Phi\ di) \tag{Ia}$$

Likewise, as for the outer rotor 20, rolling distances of the second outer rolling circle Do and the second inner rolling circle do should altogether be equal to the circumference of the base circle bo.

$$\Phi\ bo = (n+1)\cdot(\Phi\ Do + \Phi\ do) \tag{Ib}$$

Further, as for the shapes of the tooth tips of the inner rotor 10 that are established by the first outer rolling circle Di and correspond to the shapes of the tooth grooves of the outer rotor 20 which are established by the second outer rolling circle Do; and as for the shapes of the tooth tips of the outer rotor 20 that are established by the second inner rolling circle do and correspond to the shapes of the tooth grooves of the inner rotor 10 which are established by the first inner rolling circle di, the following relational expressions have to hold such that backlashes between the tooth surfaces of the two rotors 10 and 20 can be secured in a large magnitude during an engagement process.

$$\Phi\ Do > \Phi\ Di, \text{ and } \Phi\ di > \Phi\ do$$

Here, the backlashes refer to clearances that are formed, during the engagement process, between the tooth surfaces of the outer rotor 20 and the tooth surfaces of the inner rotor 10, the tooth surfaces of the inner rotor 10 in such case being the tooth surfaces opposite to those subjected to loads.

Further, in order for the inner rotor and the outer rotor to engage with each other, either one of Φ Di+Φ di=2 e and Φ Do+Φ do=2 e has to hold.

In the present invention, in order for the inner rotor 10 to successfully rotate inside the outer rotor 20; the magnitude of the backlashes to be optimized, and an engagement resistance to be reduced, while securing tip clearances, the diameter of the base circle bo of the outer rotor 20 is formed large such that the base circle bi of the inner rotor 10 and the base circle bo of the outer rotor 20 will not come into contact with each other at an engagement point of the inner rotor 10 and the outer rotor 20. That is, a relational expression (n+1)·Φ bi<n·Φ bo holds.

Obtained from this expression, expressions (Ia) and (Ib) is $$(\Phi\ Di + \Phi\ di) < (\Phi\ Do + \Phi\ do).$$

Particularly, the aforementioned engagement point refers to a point where, as shown in FIG. 2, a tooth groove of an internal tooth 21 of the outer side directly faces a tooth tip of an external tooth 11 of the inner side.

Moreover, the inner rotor 10 and the outer rotor 20 are so configured that when a clearance between the inner rotor and the outer rotor is "t", $$0.3 \leq ((\Phi\ Do + \Phi\ do) - (\Phi\ Di + \Phi\ di)) \cdot (n+1)/t \leq 0.6 \quad \text{(Ic)},$$

provided that $\Phi\ Di + \Phi\ di = 2e$; or $$0.3 \leq ((\Phi\ Do + \Phi\ do) - (\Phi\ Di + \Phi\ di)) \cdot n/t \leq 0.6 \quad \text{(Ic)},$$

provided that $\Phi\ Do + \Phi\ do = 2e$ holds ((Φ Do+Φ do)−(Φ Di+Φ di)) is referred to, hereunder, as a difference in tooth depth between the internal tooth 21 of the outer rotor 20 and the external tooth 11 of the inner rotor 10). Particularly, in (expression Ic), the unit of "clearance t" is mm (millimeter). Further, the tooth depth refers to the dimension of each tooth in the normal direction.

Further, a minimum intertooth clearance ts between the internal tooth 21 of the outer rotor 20 and the external tooth 11 of the inner rotor 10 at the engagement point shown in FIG. 2 (the lowermost part in FIG. 1) where the tooth groove and the tooth tip directly face each other, serves as a side clearance formed on both sides of the internal tooth 21 and external tooth 11 in the rotational directions thereof. Here, since the internal tooth 21 also has an intertooth clearance formed in a direction opposite to the rotational direction thereof, the smaller clearance is referred to as the minimum intertooth clearance in the description of the present embodiment.

FIG. 3 shows the locations of the minimum intertooth clearances ts. When rotationally driving the inner rotor 10 in the counterclockwise direction, a minimum intertooth clearance ts is formed on the rotational direction side of the external tooth 11 and a counter-rotational direction side of the internal tooth 21 at the location where the volume of the cell C increases (the right side in FIG. 3); a minimum intertooth clearance ts is formed on the counter-rotational direction side of the external tooth 11 and the rotational direction side of the internal tooth 21 at the location where the volume of the cell C decreases (the left side in FIG. 3); and a minimum intertooth clearance ts is formed between the tip of the external tooth 11 and the tip of the internal tooth 21 at a nonengagement point where the tooth tips directly face each other (the uppermost part in FIG. 1), the minimum intertooth clearance ts being substantially ½ the size of the clearance t.

Further, since the aforementioned (expression Ic) holds, as shown in FIG. 3, at all locations where the external teeth 11 of the inner rotor 10 and the internal teeth 21 of the outer rotor 20 are adjacent to one another (e.g. the engagement points where the tooth grooves and the tooth tips directly face each other, the locations where the volumes of the cells C increase and decrease and the locations where the tooth tips directly face each other), the minimum intertooth clearances ts between the external teeth 11 of the inner rotor 10 and the internal teeth 21 of the outer rotor 20 can be formed substantially identical to one another. In the present embodiment, the minimum intertooth clearances ts in all locations are set to be 40 μm, whereas a deviation of the minimum intertooth clearance ts to the value thus set is 10 μm, preferably in a range of not larger than 5 μm. The deviations of the minimum intertooth clearances ts of all locations to the set minimum intertooth clearance ts are each within the range of not larger than 5 μm.

However, in the present embodiment, the inner rotor 10 (base circle bi, Φ bi=44.8 mm; first outer rolling circle Di, Φ Di=3.60 mm; first inner rolling circle di, Φ di=2.80 mm; teeth number n=7) and the outer rotor 20 (outer diameter Φ 65.0 mm; base circle bo, Φ bo=51.24 mm; second outer rolling circle Do, Φ Do=3.625 mm; second inner rolling circle do, Φ do=2.78 mm) are combined at an eccentricity amount of e=3.20 mm so as to compose the oil pump rotor. Further, in the present embodiment, a tooth width (dimension in a rotary shaft direction) of both the rotors is set to be 13.2 mm. Thus, a difference in tooth depth is 0.005 mm. Furthermore, the clearance t is t=0.08 mm (80 μm); the minimum intertooth clearance ts is ts=0.037 to 0.041 mm (37 to 41 μm); and a value obtained with the expression (Ic) is 0.5. In this way, the minimum intertooth clearance ts is substantially ½ of the clearance t, and the deviation is not larger than 5 μm.

As for the casing 50, among the cells C that are formed between the tooth surfaces of both the rotors 10 and 20, formed along a cell C whose volume is in the process of increasing is an arc-shaped intake port (not shown), whereas formed along a cell C whose volume is in the process of decreasing is an arc-shaped discharge port (not shown).

The cells C are so configured that after the volume of a cell C has reached its minimum level during the process of engaging an external tooth 11 with an internal tooth 21, this cell C shall suck in a fluid by enlarging its volume when moving along the intake port; and that after the volume of this cell C has reached its maximum level, the corresponding cell C shall then discharge the fluid by decreasing its volume when moving along the discharge port.

The aforementioned expression (Ic) involves a value obtained by multiplying the difference in tooth depth by the teeth number n of the inner rotor 10 or by the teeth number (n+1) of the outer rotor 20; and then diving by the clearance t. The expression (Ic) defines a range in which not only the minimum intertooth clearances ts of all locations can be set to be small; but the deviations of the minimum intertooth clearances ts can also be small. When the teeth number n is large, it is necessary to reduce the difference in tooth depth. In contrast, when the teeth number n is small, it is then necessary to make the difference in tooth depth large. That is, the difference in tooth depth that changes as the teeth number n increases or decreases and the clearance t bear a proportionate relationship to each other within a given range.

In this way, since 0.3≤((Φ Do+Φ do)−(Φ Di+Φ di))·(n+1)/t≤0.6 when Φ Di+Φ di=2 e, or since 0.3≤((Φ Do+Φ do)−(Φ Di+Φ di))·n/t≤0.6 when Φ Do+Φ do=2 e, the minimum intertooth clearances ts can be equalized and shrunk such that engagement noises or the like may be reduced and a volume efficiency may be improved. If not exceeding 0.3 or if exceeding 0.6, it becomes difficult to equalize the minimum intertooth clearances ts.

Figure 5:
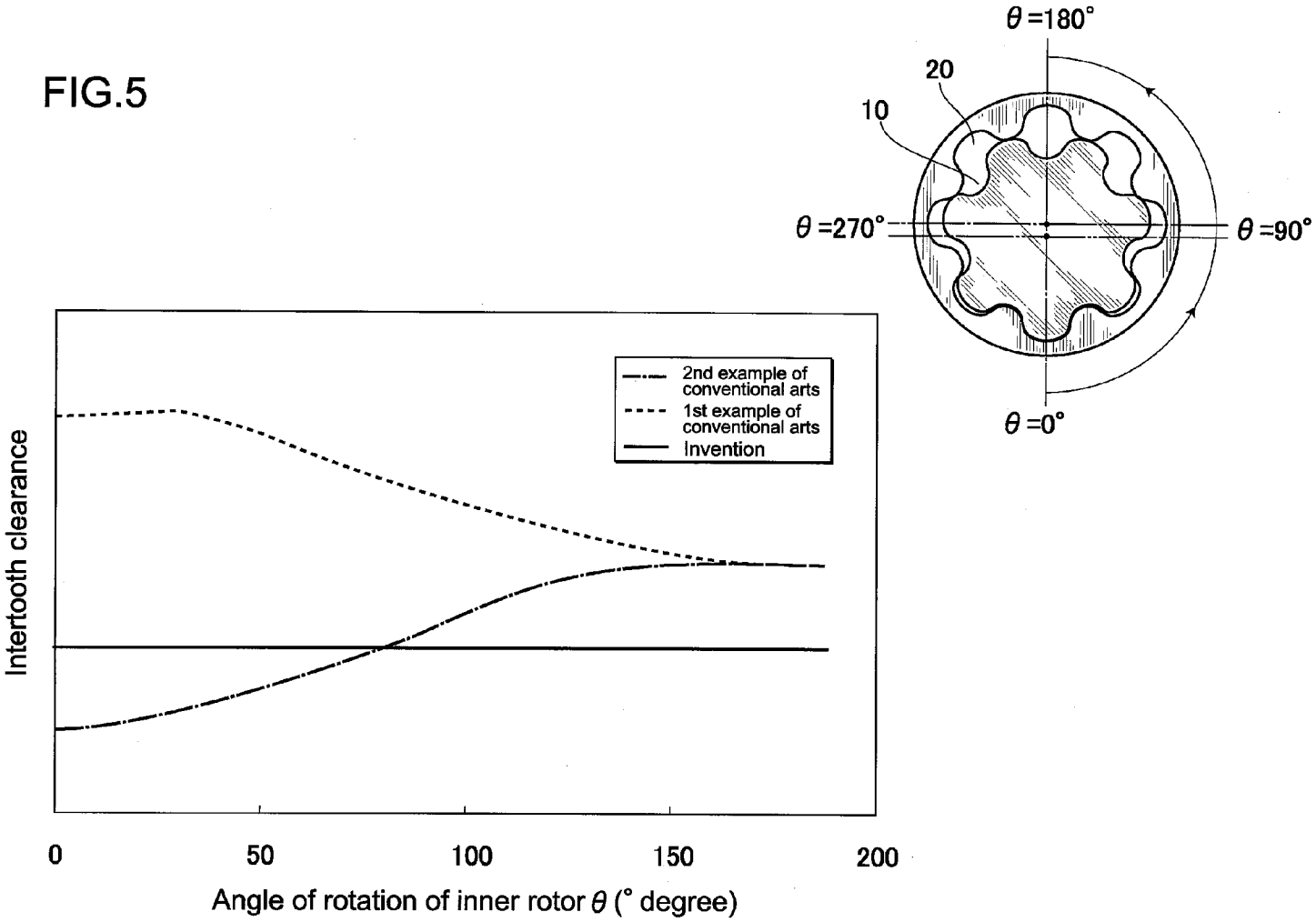
FIG. 5 is a graph comparing the minimum intertooth clearances of the oil pump rotor of the present invention and the oil pump rotors of the first and second examples of conventional arts.

FIG. 5 shows a graph comparing: the intertooth clearance at each angle of rotation of an inner rotor used in an oil pump rotor of a conventional technique 1 (Japanese Patent No. 3734617) (dashed line in FIG. 5); the intertooth clearance at each angle of rotation of an inner rotor used in an oil pump rotor of a conventional technique 2 (Japanese Patent No. 4485770) (dashed-dotted line in FIG. 5); and the intertooth clearance at each angle of rotation of the inner rotor used in the oil pump rotor of the present embodiment (continuous line in FIG. 5). According to this graph, the oil pump rotor of the present embodiment which is the "invention" makes it possible for the minimum intertooth clearances of all locations to be formed small and substantially equalized. Therefore, while the conventional techniques bore a problem where a variation in tooth shape could have led to tooth interferences in regions with small intertooth clearances, the developed product is capable of securing appropriate intertooth clearances, thereby making it possible to easily avoid the aforementioned problem and realize a smooth rotation. Here, in FIG. 5, the reason that only the intertooth clearances at the angles of rotation of 0° to 180° are denoted is because changes in intertooth clearance from 180° to 360° (0°) are similar to that from 180° to 0° shown in FIG. 5, thus omitting the description thereof.

Figure 6:
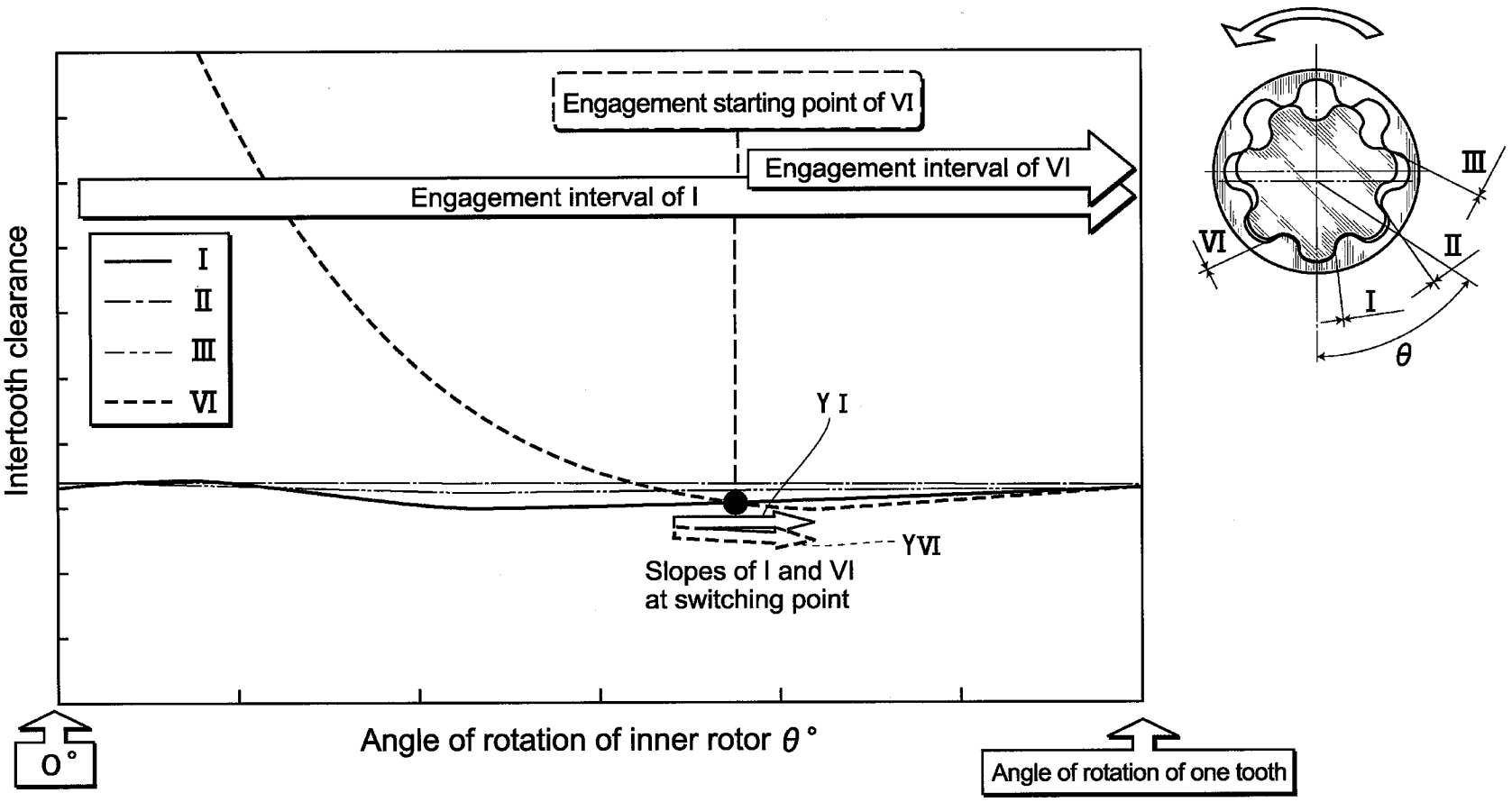
FIG. 6 is a graph showing a correlation between the minimum intertooth clearances and angles of rotation of an inner rotor.
Figure 7:
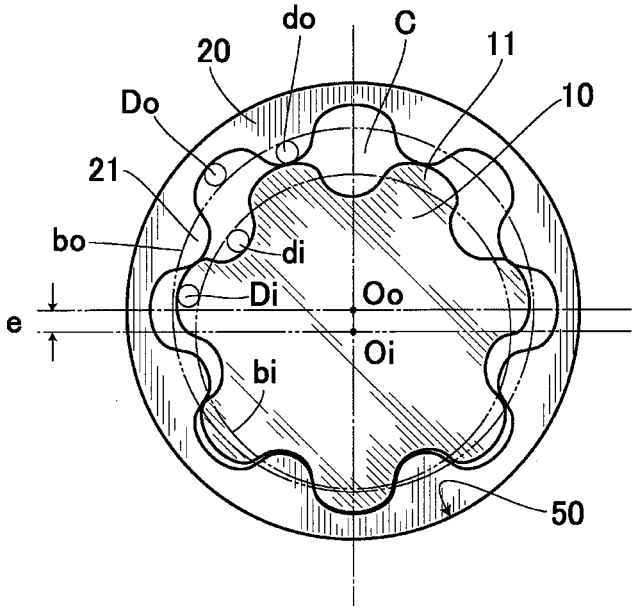
FIG.7 (RELATED ART)
FIG. 7 is a plane view of an oil pump rotor of the second example of conventional arts.
Figure 8:
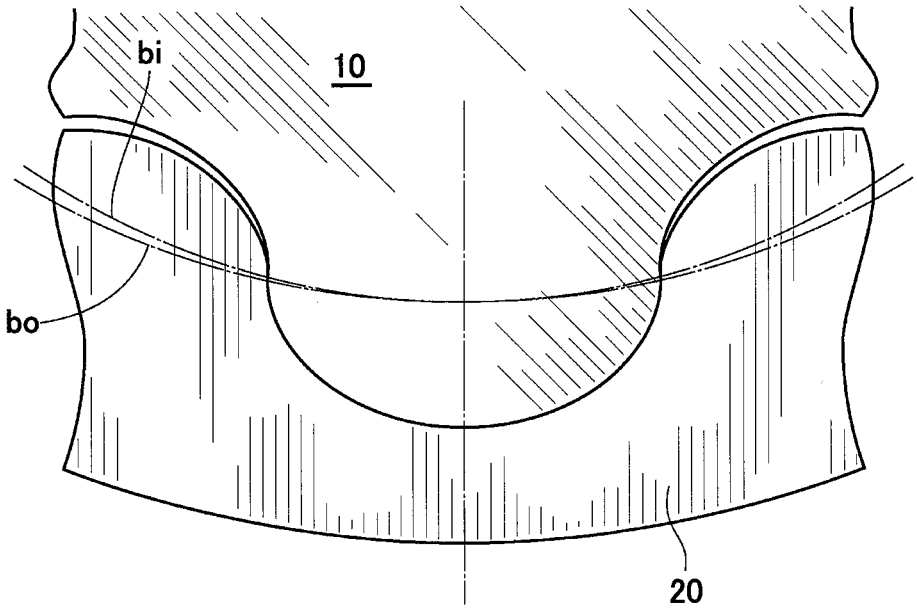
FIG.8 (RELATED ART)
FIG. 8 is an enlarged view of an engaged section of an oil pump of the second example of conventional arts shown in FIG. 7.
Figure 9:
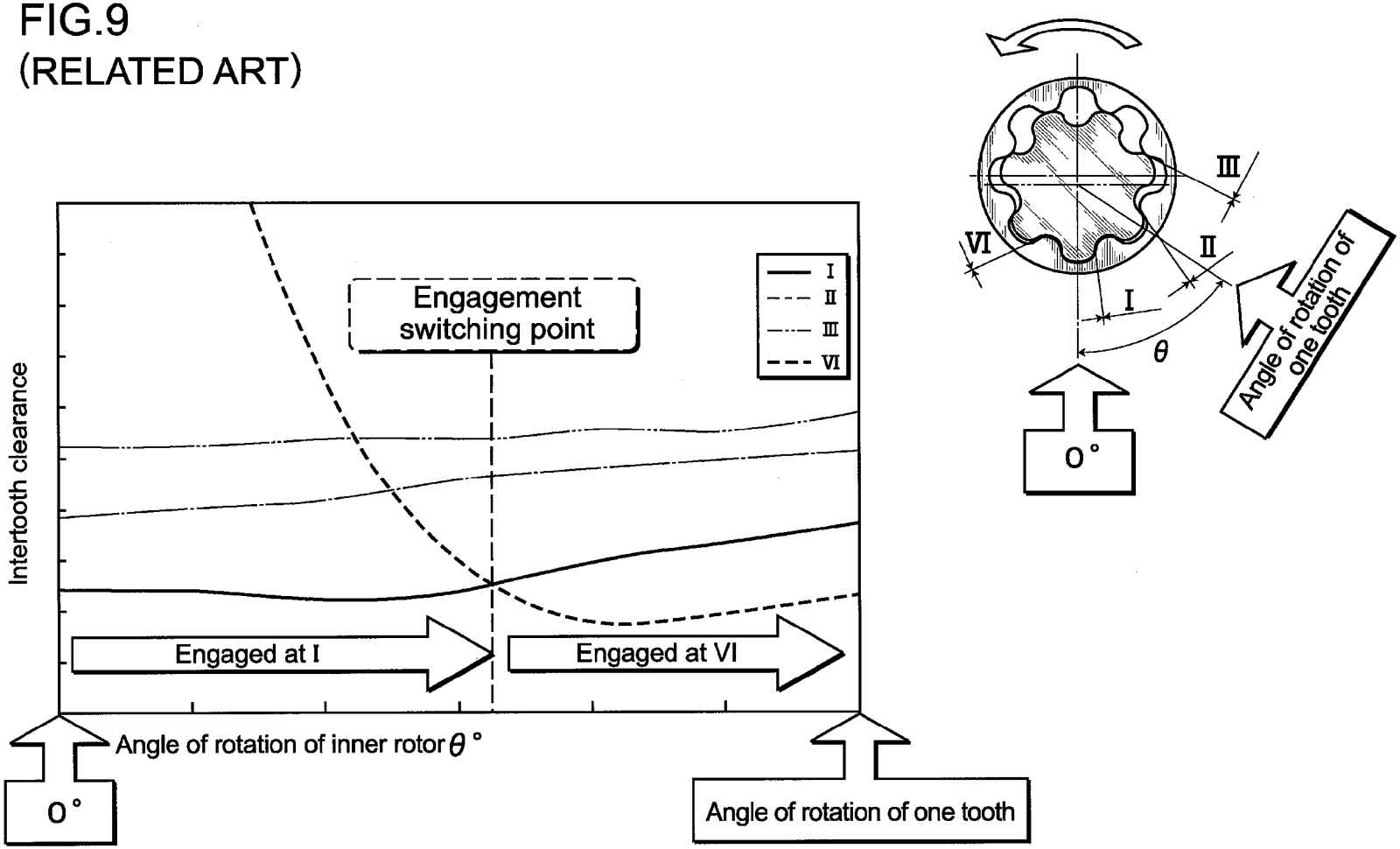
FIG.9 (RELATED ART)
FIG. 9 is a graph showing a correlation between intertooth clearances and angles of rotation of an inner rotor of the second example of conventional arts.
Figure 10:
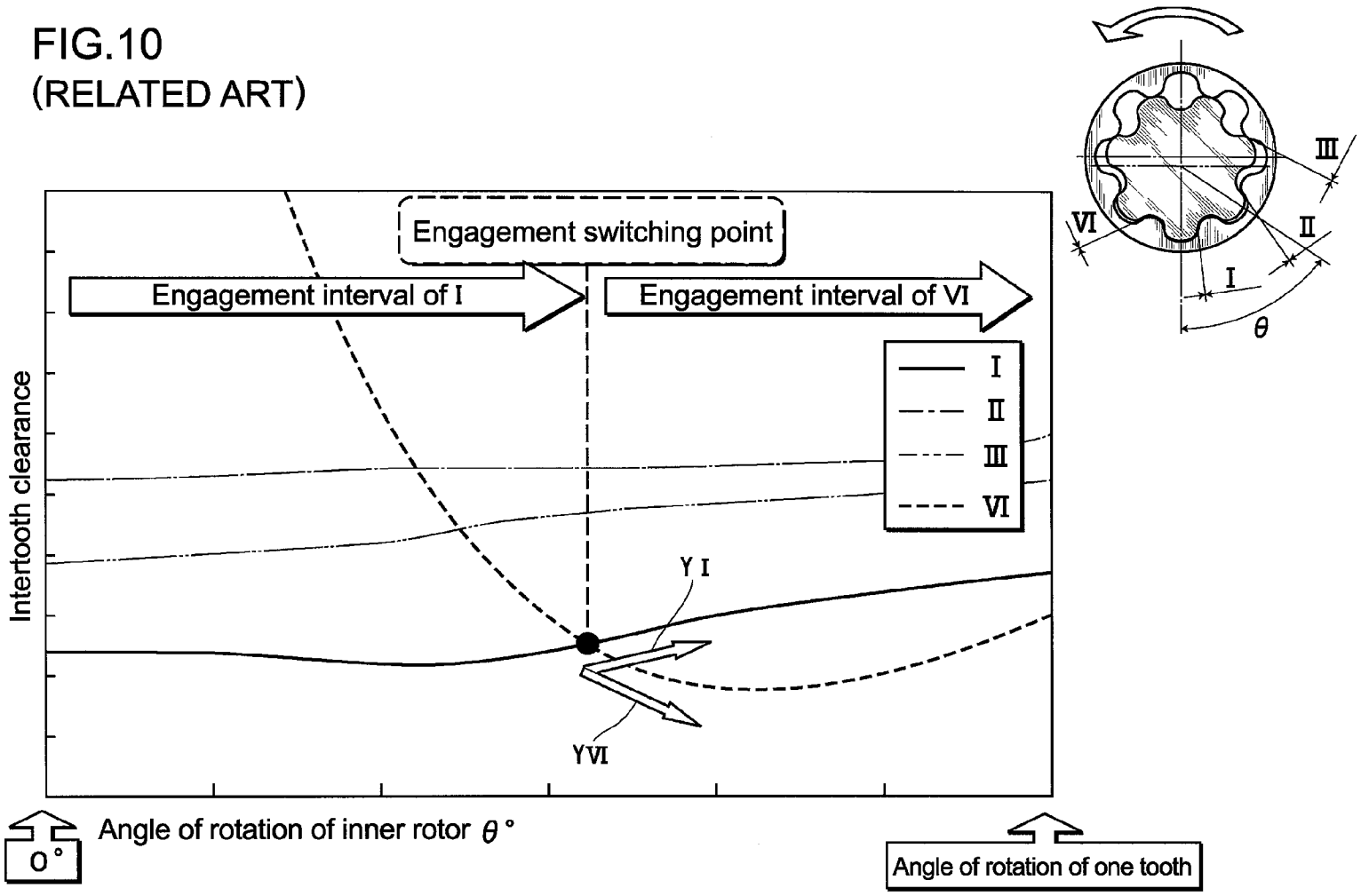
FIG.10 (RELATED ART)
FIG. 10 is a graph showing the correlation between intertooth clearances and angles of rotation of the inner rotor of the second example of conventional arts, in which the displacement velocities of the intertooth clearances are diagrammatically indicated by arrows.
Figure 11:
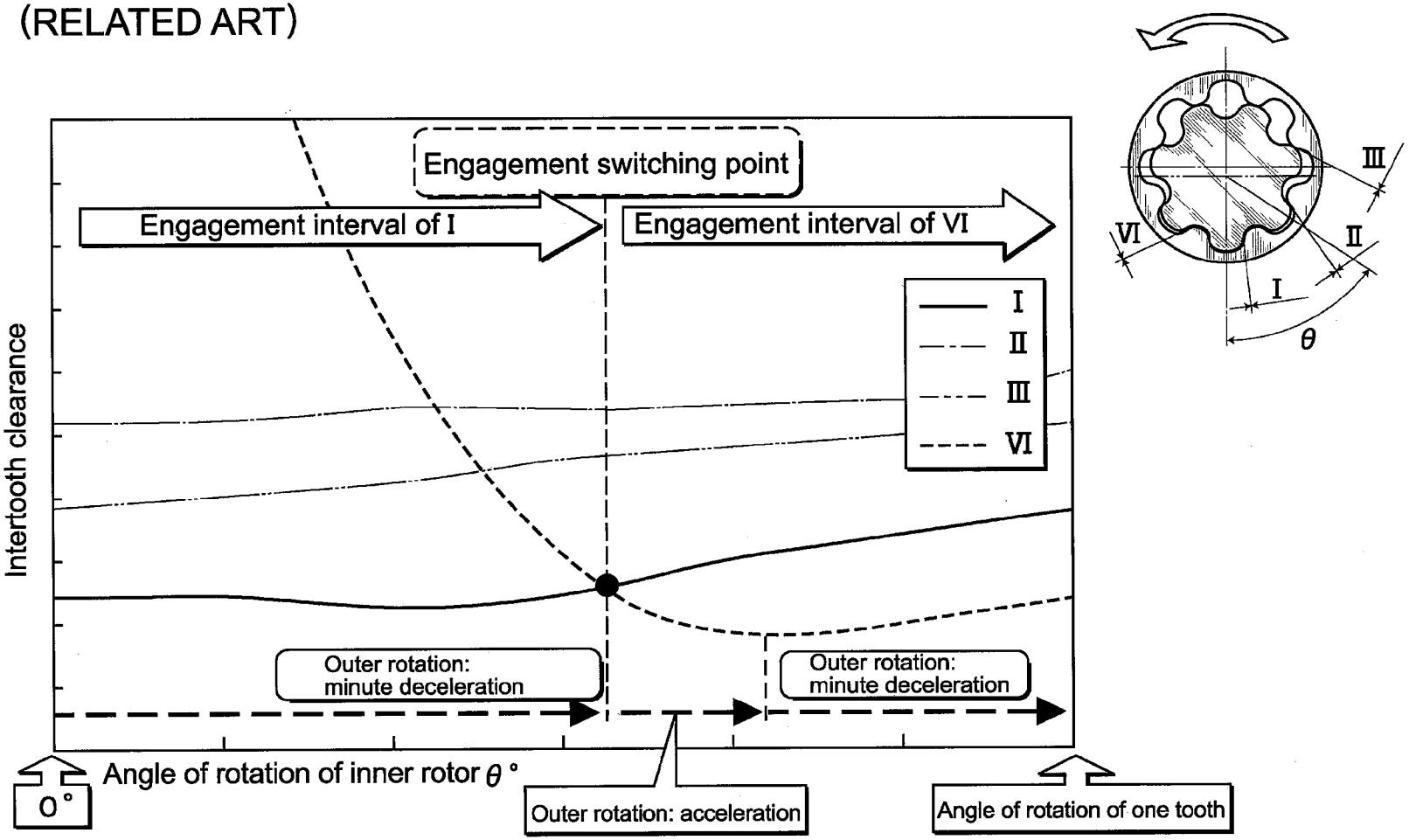
FIG.11 (RELATED ART)
FIG. 11 is a graph showing the correlation between intertooth clearances and angles of rotation of the inner rotor of the second example of conventional arts, in which diagrammatically indicated are ranges of minute deceleration, acceleration and then minute deceleration of an outer rotor of the second example of conventional arts.
Figure 12:
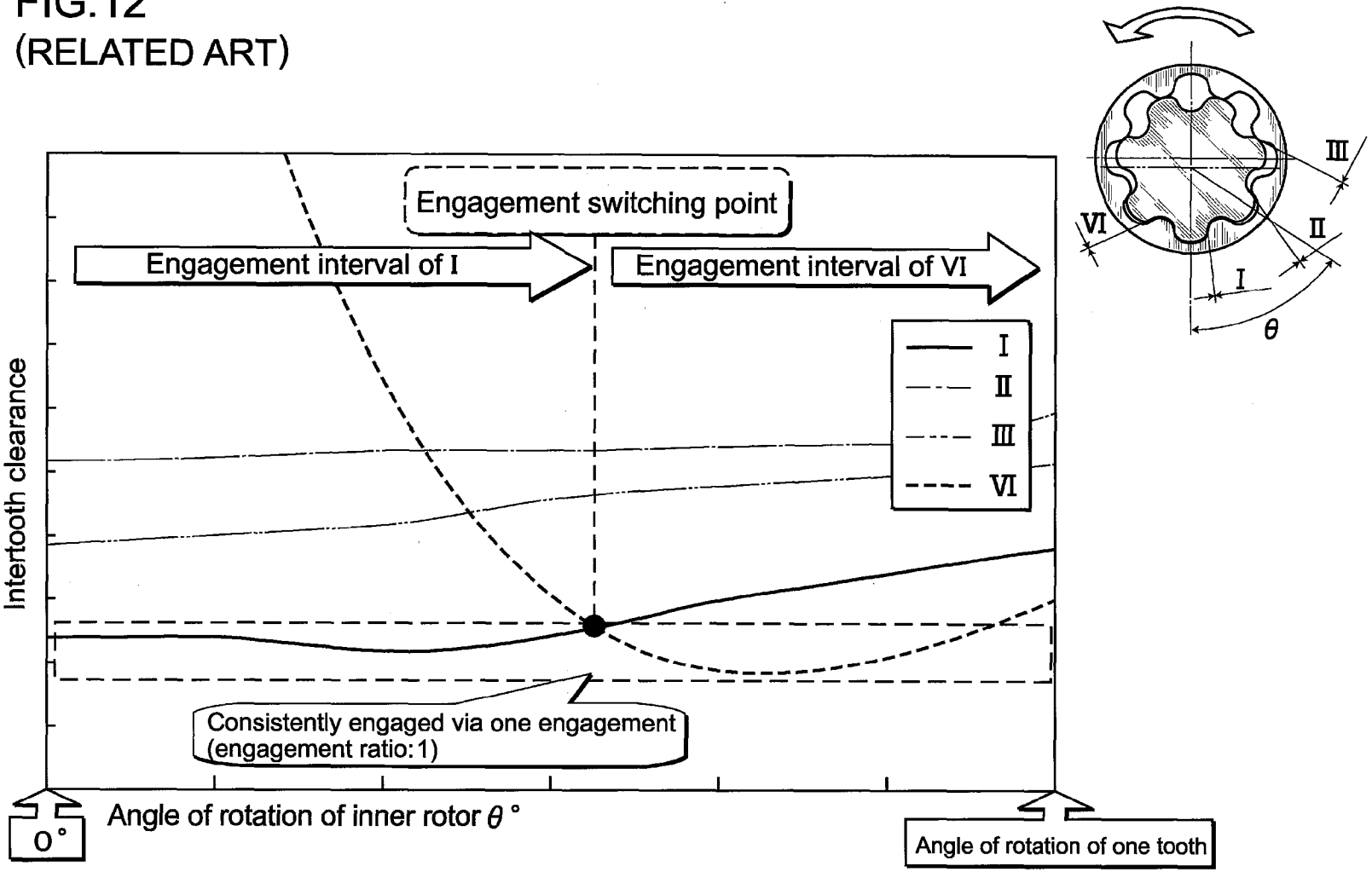
FIG.12 (RELATED ART)
FIG. 12 is a graph showing the correlation between intertooth clearances and angles of rotation of the inner rotor of the second example of conventional arts, in which engagement intervals I and VI are diagrammatically indicated.
Figure 13:
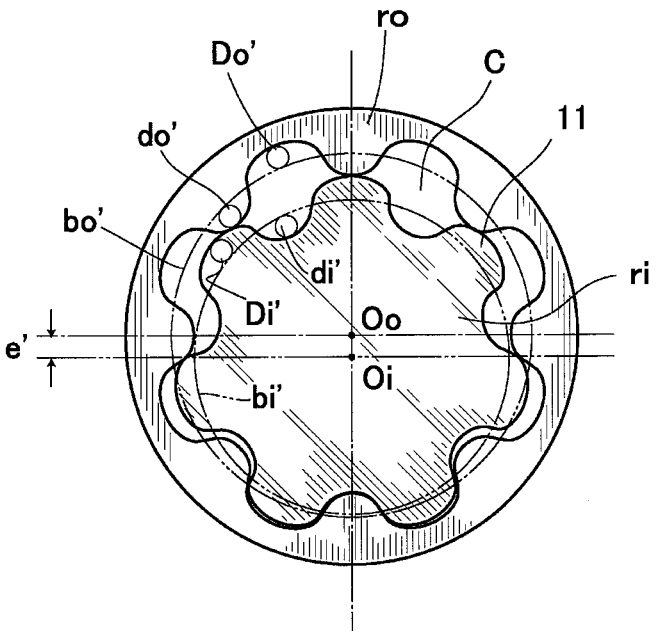
FIG.13 (RELATED ART)
FIG. 13 is a plane view of an oil pump rotor of the first example of conventional arts.
Figure 14:
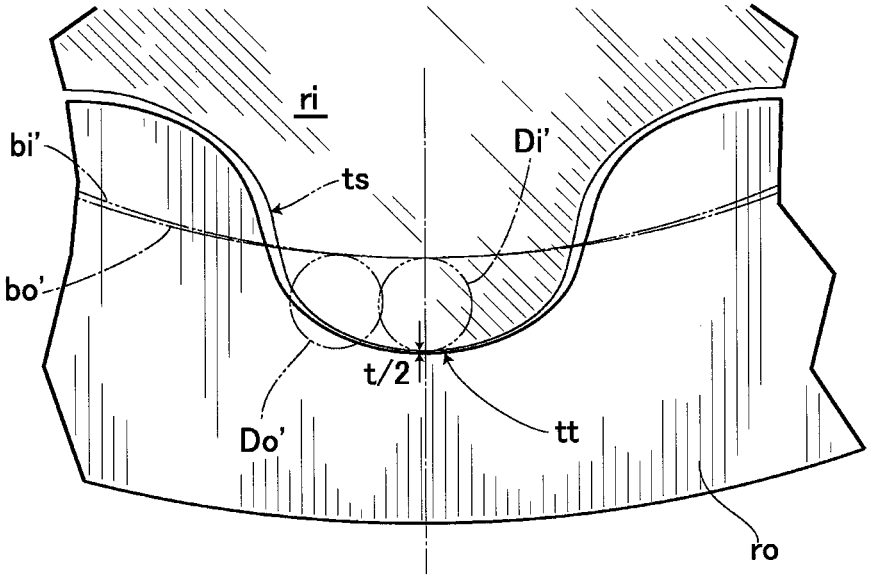
FIG.14 (RELATED ART)
FIG. 14 is an enlarged view of an engaged section of an oil pump of the first example of conventional arts shown in FIG. 13.
Figure 15:
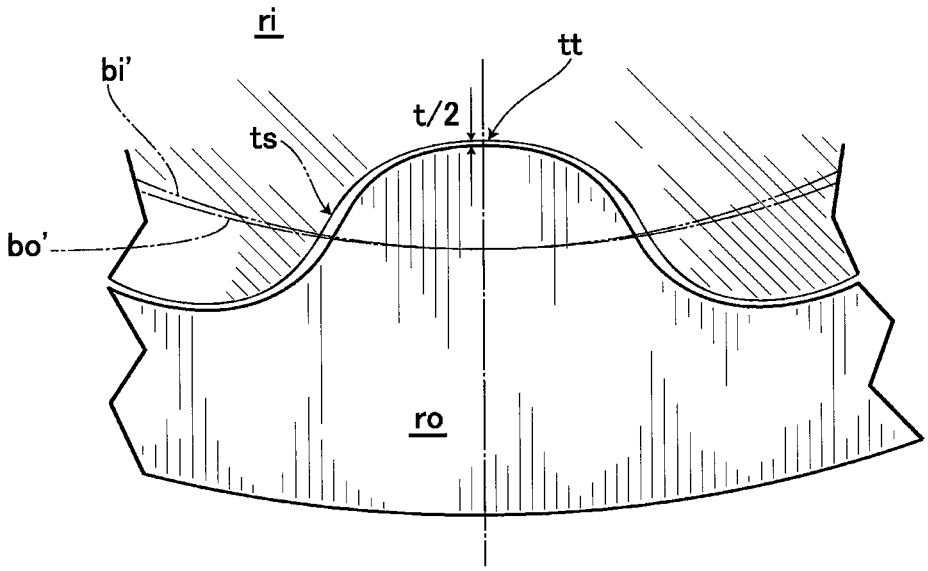
FIG.15 (RELATED ART)
FIG. 15 is an enlarged view of the engaged section of the oil pump of the first example of conventional arts, showing an engaged state of a tooth tip of an outer rotor and a tooth groove of an inner rotor.

Further, FIG. 6 shows a graph obtained by applying the graphs of FIG. 9 to FIG. 12 of the examples of conventional arts to the "invention." As indicated by the symbols YI, YVI in FIG. 6, since the displacement velocities are synchronized, engagement at the location of VI can start to take place smoothly, thus making it possible to restrict tooth contact noises. Moreover, a difference in intertooth clearance between the locations of I and VI at/beyond an "engagement switching point" is small (deviation of not larger than 5 μm, 1 to 3 μm in FIG. 6), thus making it possible to improve a contact ratio and restrict engagement mechanical noises. In addition, since the outer rotor 20 does not accelerate or decelerate, rotational noises of the outer rotor 20 can be restricted, thereby improving quietness as a whole.

Figure 4:
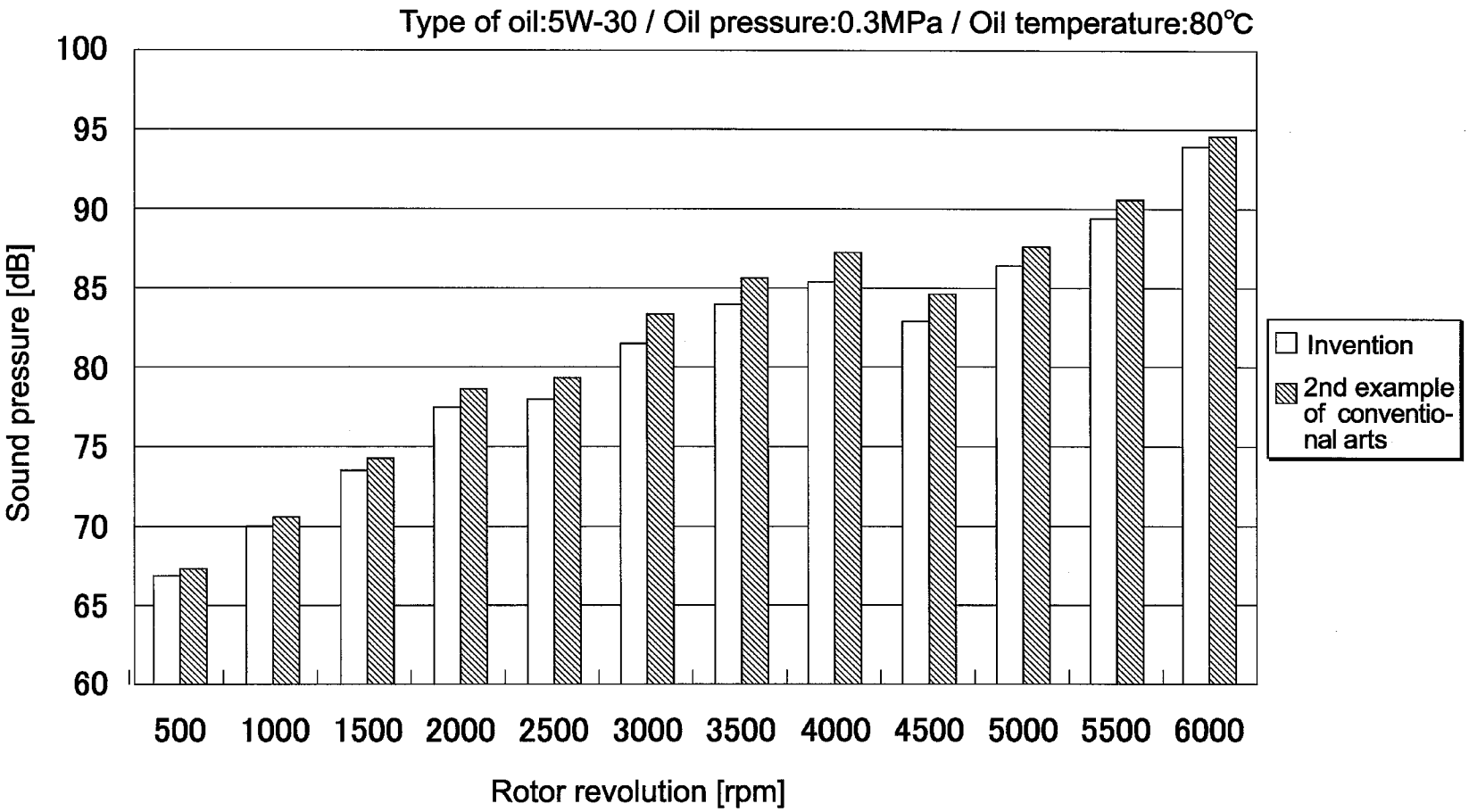
FIG. 4 is a graph showing correlations between rotor revolution and sound pressure with regard to an oil pump of the present invention and an oil pump of the second example of conventional arts.

Here, shown in FIG. 4 are correlations between rotor revolution and sound pressure with regard to the oil pump of the present invention and the conventional oil pump, from which it is understood that the present invention is capable of improving quietness.

Further, the minimum intertooth clearances is between the external teeth 11 of the inner rotor 10 and the internal teeth 21 of the outer rotor 2 are substantially equalized at all locations where the external teeth 11 of the inner rotor 10 and the internal teeth 21 of the outer rotor 20 are adjacent to one another (engagement points where the tooth grooves and tooth tips directly face one another; locations where the volumes of the cells C increase and decrease; and locations where the tooth tips directly face one another). Therefore, for the purpose of improving volume efficiency, since the minimum intertooth clearances at the locations where the cells C reach their maximum levels are reduced, the minimum intertooth clearance at each tooth shall not be exceedingly small even when attempting to improve fluid tightness. For this reason, appropriate intertooth clearances can be secured, thus making it possible to prevent the teeth from interfering with one another and restrict noises.

In this way, the oil pump rotor of the present embodiment described above includes: the inner rotor having "n" (n is a natural number) external teeth; the outer rotor having "n+1" internal teeth engageable with the external teeth; and the casing having the intake port for a fluid to be drawn thereinto and the discharge port for the fluid to be discharged therefrom. Particularly, this oil pump rotor is used in an oil pump transferring a fluid by drawing in and discharging the same as the volumes of the cells formed between the tooth surfaces of the two rotors change when the two engaged rotors rotate.

As for the aforementioned inner rotor, the shape of each tooth tip of the inner rotor is established by the epicycloid curve that is generated by the first outer rolling circle Di externally tangent to and rolling on the base circle bi of the inner rotor without slipping. The shape of each tooth groove of the inner rotor is established by the hypocycloid curve that is generated by the first inner rolling circle di internally tangent to and rolling within the base circle bi without slipping.

As for the aforementioned outer rotor, the shape of each tooth groove of the outer rotor is established by the epicycloid curve that is generated by the second outer rolling circle Do externally tangent to and rolling on the base circle bo of the outer rotor without slipping. The shape of each tooth tip of the outer rotor is established by the hypocycloid curve that is generated by the second inner rolling circle do internally tangent to and rolling within the base circle bo without slipping.

When the diameter of the base circle bi of the inner rotor is Φ bi; the diameter of the first outer rolling circle Di is Φ Di; the diameter of the first inner rolling circle di is Φ di; the diameter of the base circle bo of the outer rotor is Φ bo; the diameter of the second outer rolling circle Do is Φ Do; the diameter of the second inner rolling circle do is Φ do; and the eccentricity amount between the inner rotor and the outer rotor is e, the expression $\Phi\ bi=n\cdot(\Phi\ Di+\Phi\ di)$ and the expression $\Phi\ bo=(n+1)\cdot(\Phi\ Do+\Phi\ do)$ hold; the expression $\Phi\ Di+\Phi\ di=2\ e$ or $\Phi\ Do+\Phi\ do=2\ e$ holds;

and the expressions $\Phi\ Do>\Phi\ Di$, $\Phi\ di>\Phi\ do$ and $(\Phi\ Di+\Phi\ di)<(\Phi\ Do+\Phi\ do)$ hold.

Here, the inner rotor and the outer rotor are also configured in a manner such that when $\Phi\ Di+\Phi\ di=2\ e$, the expression $0.3\leq((\Phi\ Do+\Phi\ do)-(\Phi\ Di+\Phi\ di))\cdot(n+1)/t\leq 0.6$ holds, or that when $\Phi\ Do+\Phi\ do=2\ e$, the expression $0.3\leq((\Phi\ Do+\Phi\ do)-(\Phi\ Di+\Phi\ di))\cdot n/t\leq 0.6$ holds, provided that the clearance between the inner rotor and the outer rotor is t.

For this reason, there can be obtained an oil pump with a superior quietness. Especially, since the minimum intertooth clearances ts can be equalized, contact noises, vibration sounds and engagement mechanical noises at the engagement switching point can be prevented from occurring such that not only the quietness of the oil pump rotor can be reliably achieved, but the volume efficiency can be improved as a result of improving the sealability. Particularly, the deviation of the minimum intertooth clearance ts is set to be 10 μm, preferably in the range of not larger than 5 μm.

Further, as an effect of the embodiment, since the deviation of each intertooth clearance ts to the inner rotor is constantly 10 μm, preferably not larger than 5 μm, under the condition in which when $\Phi\ Di+\Phi\ di=2\ e$, the expression $0.3\leq((\Phi\ Do+\Phi\ do)-(\Phi\ Di+\Phi\ di))\cdot(n+1)/t\leq 0.6$ holds; or the condition in which when $\Phi\ Do+\Phi\ do=2\ e$, the expression $0.3\leq((\Phi\ Do+\Phi\ do)-(\Phi\ Di+\Phi\ di))\cdot n/t\leq 0.6$ holds, the minimum intertooth clearances ts which are the appropriate clearance gaps can be secured at engaged sections even when the clearance t is formed small. Therefore, it is possible to avoid the interferences between the external teeth 11 and the internal teeth 12 by absorbing variation in part accuracy, thereby realizing a smooth rotation, thus improving mechanical efficiency. Moreover, by making the minimum intertooth clearances ts small, e.g., as small as 35 to 45 μm, preferably 37.5 to 42.5 μm, the sealability between the external teeth 11 and the internal teeth 21 at where the volumes of the cells reach their maximum levels increases, thereby making it possible to improve volume efficiency.

However, the present invention is not limited to the aforementioned embodiment. In fact, various modified embodiments are possible.

DESCRIPTION OF THE SYMBOLS

10 inner rotor
11 external teeth
20 outer rotor
21 internal teeth
50 casing Di outer rolling circle of inner rotor (first outer rolling circle)

Do outer rolling circle of outer rotor (second outer rolling circle)

di inner rolling circle of inner rotor (first inner rolling circle)

do inner rolling circle of outer rotor (second inner rolling circle)

C cell bi base circle of inner rotor bo base circle of outer rotor

Oi shaft center of inner rotor

Oo shaft center of outer rotor t clearance ts minimum intertooth clearance

The invention claimed is:

1. An oil pump rotor for use in an oil pump transferring a fluid by drawing in and discharging said fluid as volumes of cells formed between tooth surfaces of two rotors that change when said two rotors rotate while being engaged with each other, said oil pump rotor comprising:

an inner rotor having n (n is a natural number) external teeth, said inner rotor exhibiting a tooth tip shape established by an epicycloid curve that is generated by a first outer rolling circle Di externally tangent to and rolling on a base circle bi of said inner rotor without slipping and a tooth groove shape established by a hypocycloid curve that is generated by a first inner rolling circle di internally tangent to and rolling within said base circle bi without slipping;

an outer rotor having n+1 internal teeth, said outer rotor exhibiting a tooth groove shape established by an epicycloid curve that is generated by a second outer rolling circle Do externally tangent to and rolling on a base circle bo of said outer rotor without slipping and a tooth tip shape established by a hypocycloid curve that is generated by a second inner rolling circle do internally tangent to and rolling within said base circle bo without slipping; and a casing having an intake port for drawing in a fluid and a discharge port for discharging the fluid, wherein the inner and outer rotors are formed to satisfy:

$$\Phi bi=n(\Phi Di+\Phi di),\ \Phi bo=(n+1)\cdot(\Phi Do+\Phi do);$$

$$\Phi Di+\Phi di=2e;$$

$$\Phi \mathrm{Do}>\Phi Di,\ \Phi di>\Phi do,\ (\Phi Di+\Phi di)<(\Phi Do+\Phi do),$$

and, $$0.3\leq((\Phi Do+\Phi do)-(\Phi Di+\Phi di))\cdot(n+1)/t\leq 0.6;$$

or, $$\Phi bi=n\cdot(\Phi Di+\Phi di),\ \Phi bo=(n+1)\cdot\Phi Do+\Phi do)$$

$$\Phi Do+\Phi do=2e$$

$$\Phi Do>\Phi Di,\ \Phi di>\Phi do,\ (\Phi Di+\Phi di)<(\Phi Do+\Phi do)$$

and, $$0.3\leq((\Phi Do+\Phi do)-(\Phi Di+\Phi di))\cdot n/t\leq 0.6$$

where Φ bi, Φ Di, Φ di, Φ bo, Φ Do, Φ do, e, and t respectively indicate a diameter of said base circle bi, a diameter of said first outer rolling circle Di, a diameter of said first inner rolling circle di, a diameter of said base circle bo, a diameter of said second outer rolling circle Do, a diameter of a second inner rolling circle do, an eccentricity amount between said inner rotor and a said outer rotor and a clearance between said inner rotor and said outer rotor.

2. The oil pump rotor according to claim 1, wherein said external teeth of said inner rotor and said internal teeth of said outer rotor exhibit there between a minimum inter-tooth clearance with a deviation of not larger than 10 μm, at all locations where said external teeth of said inner rotor and said internal teeth of said outer rotor are adjacent to one another.

3. The oil pump rotor according to claim 2, wherein said minimum inter-tooth clearance is 35 to 45 μm.

4. The oil pump rotor according to claim 1, wherein said deviation of said minimum inter-tooth clearance is not larger than 5 μm.

5. The oil pump rotor according to claim 4, wherein said minimum inter-tooth clearance is 37.5 to 42.5 μm.

* * * * *